US008627839B1

(12) United States Patent
Martinez

(10) Patent No.: US 8,627,839 B1
(45) Date of Patent: Jan. 14, 2014

(54) MOBILITY SYSTEM FOR THE VISUALLY IMPAIRED

(76) Inventor: Jose M. Martinez, Rensselaer, NY (US)

( * ) Notice: Subject to any disclaimer, the term of this patent is extended or adjusted under 35 U.S.C. 154(b) by 27 days.

(21) Appl. No.: 13/445,485

(22) Filed: Apr. 12, 2012

Related U.S. Application Data

(63) Continuation-in-part of application No. 12/717,302, filed on Mar. 4, 2010, now abandoned.

(51) Int. Cl.
*A45B 3/00* (2006.01)

(52) U.S. Cl.
USPC ..... 135/66

(58) Field of Classification Search
USPC ..... 135/66
See application file for complete search history.

(56) References Cited

U.S. PATENT DOCUMENTS

| | | | | |
|---|---|---|---|---|
| 3,546,467 | A | 12/1970 | Benjamin, Jr. et al. | |
| 3,996,950 | A * | 12/1976 | Mier | 135/66 |
| 5,056,545 | A | 10/1991 | Spaeth | |
| 5,807,111 | A | 9/1998 | Schrader | |
| D441,950 | S | 5/2001 | Suen | |
| 6,239,700 | B1 | 5/2001 | Hoffman et al. | |
| 6,272,562 | B1 | 8/2001 | Scott et al. | |
| 6,356,210 | B1 | 3/2002 | Ellis | |
| 6,470,264 | B2 | 10/2002 | Bide | |
| 6,774,795 | B2 | 8/2004 | Eshelman et al. | |
| 7,267,281 | B2 | 9/2007 | Hopkins | |
| 7,317,927 | B2 | 1/2008 | Staton et al. | |
| 7,654,275 | B2 | 2/2010 | Ewell et al. | |
| 2005/0211284 | A1 | 9/2005 | Dooley | |
| 2006/0028544 | A1 | 2/2006 | Tseng | |
| 2008/0072940 | A1 | 3/2008 | Cheng et al. | |
| 2008/0251110 | A1 | 10/2008 | Pede | |
| 2009/0038663 | A1 | 2/2009 | Juslin et al. | |
| 2009/0199884 | A1 | 8/2009 | Lessing | |
| 2009/0223546 | A1 | 9/2009 | Nazarian | |

* cited by examiner

*Primary Examiner* — Noah Chandler Hawk

(57) ABSTRACT

A mobility system for the visually impaired has a removable data processing module attached to a generally elongated collapsible pole. The pole has a proximity sensor located close to a pole first end and a second proximity sensor located a pole second end. The pole has a fingerprint scanner located close to the pole first end. The system has a data processing module that has a microprocessor, a power switch, a power supply, a charging port, a data port, a microphone, and a speaker located within the module housing. The microprocessor has a global positioning system component. The data processing module can be attached to the collapsible pole or carried by the user via a strap or a clip. The fingerprint scanner can turn on or off the system based on the fingerprint of the user.

18 Claims, 4 Drawing Sheets

MOBILITY SYSTEM FOR THE VISUALLY IMPAIRED

CROSS REFERENCE

This application claims priority to U.S. non-provisional application Ser. No. 12/717,302 filed Mar. 4, 2010 as a continuation-in-part, the specification of which is incorporated herein by reference in its entirety.

BACKGROUND OF THE INVENTION

White canes, specifically, have been used by the visually impaired since the early nineteen hundreds even though walking aids or canes in general have been used to aid the mobility of the disabled for centuries. Many different methods have been explored throughout the years including in more recent times, global positioning systems which are commonly used for navigation when driving, biking, or walking. The present invention teaches a novel mobility system for the visually impaired having a removable data processing module containing global positioning system capabilities, attached to a collapsible pole.

SUMMARY

The present invention features a mobility system for the visually impaired having a removable data processing module attached to a collapsible pole.

In some embodiments, the system comprises a generally elongated collapsible pole having a module mount first interface and a module mount power and data first interface located on the pole. In some embodiments, the pole further comprises a proximity sensor located on the pole close to a pole first end and a proximity sensor located on the pole close to a pole second end. In some embodiments, the pole further comprises a fingerprint scanner located on the pole close to the pole first end.

In some embodiments, the system comprises a data processing module comprising a module housing having a mating module mount second interface for attaching to the module mount first interface and a module mount power and data second interface for operatively connecting with the module mount power and data first interface. In some embodiments, the data processing module further comprises a microprocessor, a power switch, a power supply, a charging port, a data port, a microphone, and a speaker located within the module housing. In some embodiments, the microprocessor comprises a voice recognition component. In some embodiments, a voice input signal received using the microphone can be converted into an instruction signal for the microprocessor.

In some embodiments, the microprocessor comprises a global positioning system component. In some embodiments, the global positioning system component can be activated by and receive instructions from the voice recognition component. In some embodiments, the global positioning component can provide location information and directions for the user using the speaker.

In some embodiments, the data processing module can be attached to the collapsible pole or carried by the user using a strap or a clip. In some embodiments, the fingerprint scanner can turn on or off the system based on the fingerprint of the user. In some embodiments, the microprocessor can activate an alarm using the speaker upon detecting an unrecognized fingerprint of a second, unauthorized user.

In some embodiments, the ground proximity sensor located close to the pole second end can detect an obstacle at or near ground level. In some embodiments, the microprocessor can activate the alarm using the speaker upon detecting an obstacle in the path of the user. In some embodiments, the handle proximity sensor located close to the pole first end can detect an obstacle at or near head level of the user. In some embodiments, the microprocessor can activate the alarm using the speaker upon detecting an obstacle in the path of the user.

Any feature or combination of features described herein are included within the scope of the present invention provided that the features inclu in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
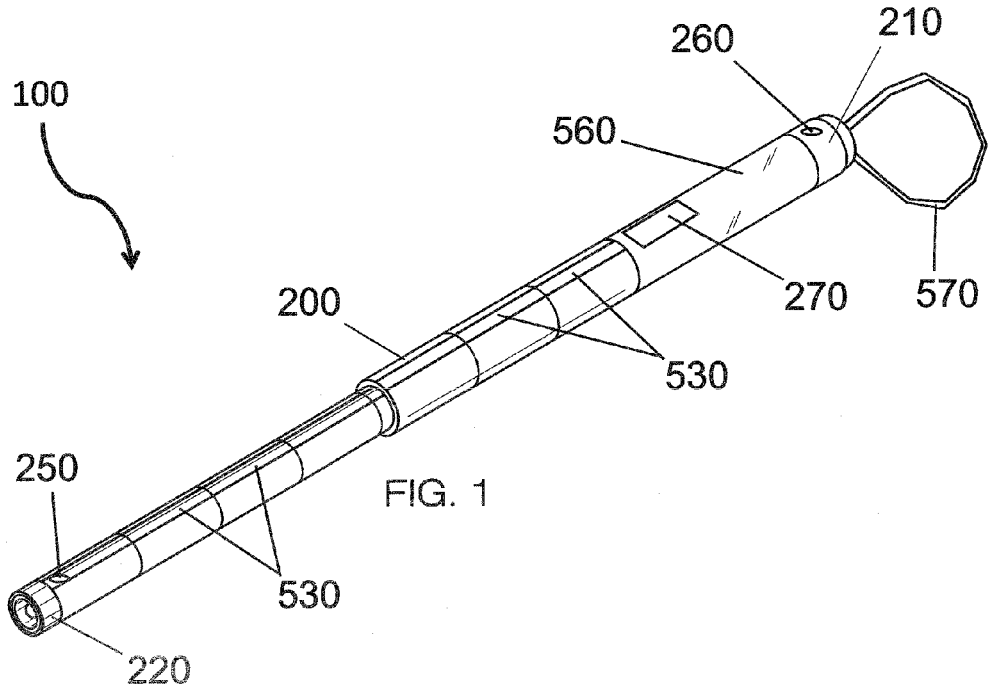
FIG. 1 is a perspective view of the top of the present invention with the data processing module removed.

Following is a list of elements corresponding to a particular element referred to herein:

100 Mobility system
200 Collapsible pole
210 Pole first end
220 Pole second end
230 Module mount first interface
240 Module mount power and data first interface
250 Foot proximity sensor
260 Head proximity sensor
270 Fingerprint scanner
300 Data processing module
310 Module housing
320 Module mount second interface
330 Module mount power and data second interface
400 Microprocessor
410 Power switch
420 Power supply
430 Charging port
440 Data port
450 Microphone
460 Speaker
500 Strap
510 Clip
530 Reflective component
540 Camera
550 Earpiece
560 Handgrip
570 Wrist strap
580 Power supply indicator light
590 Collapsible pole activation switch
600 Foot proximity wand
610 Head proximity wand

620 Pole extension motor assembly

Figure 2:
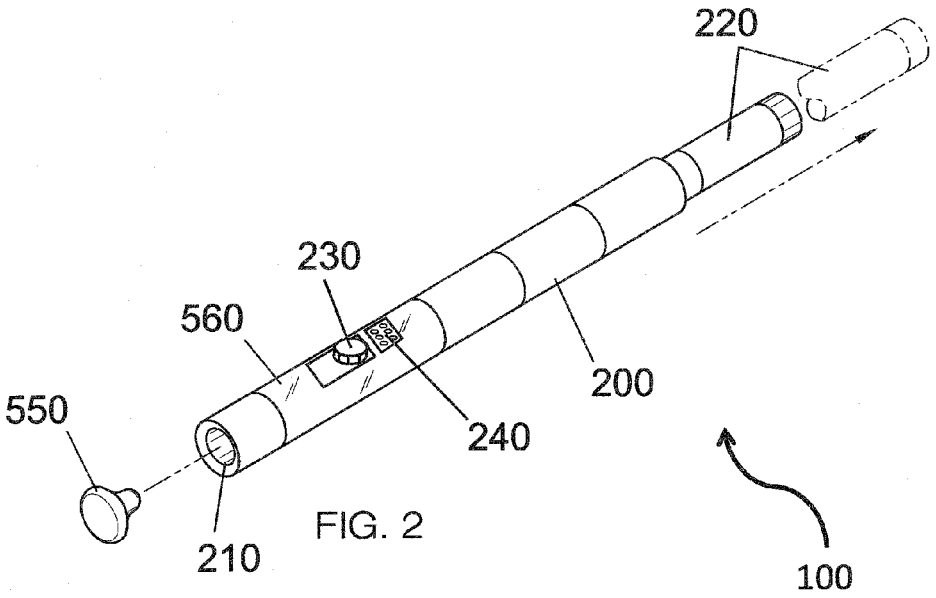
FIG. 2 is a perspective view of the bottom of the present invention with the data processing module removed.
Figure 3:
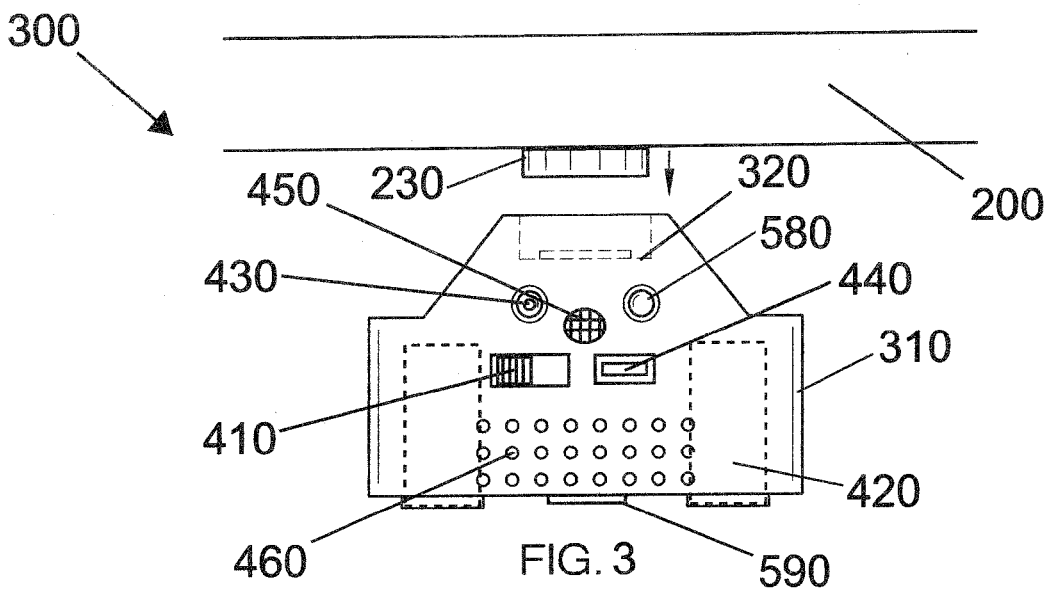
FIG. 3 is a top view of the data processing module of the present invention.
Figure 4:
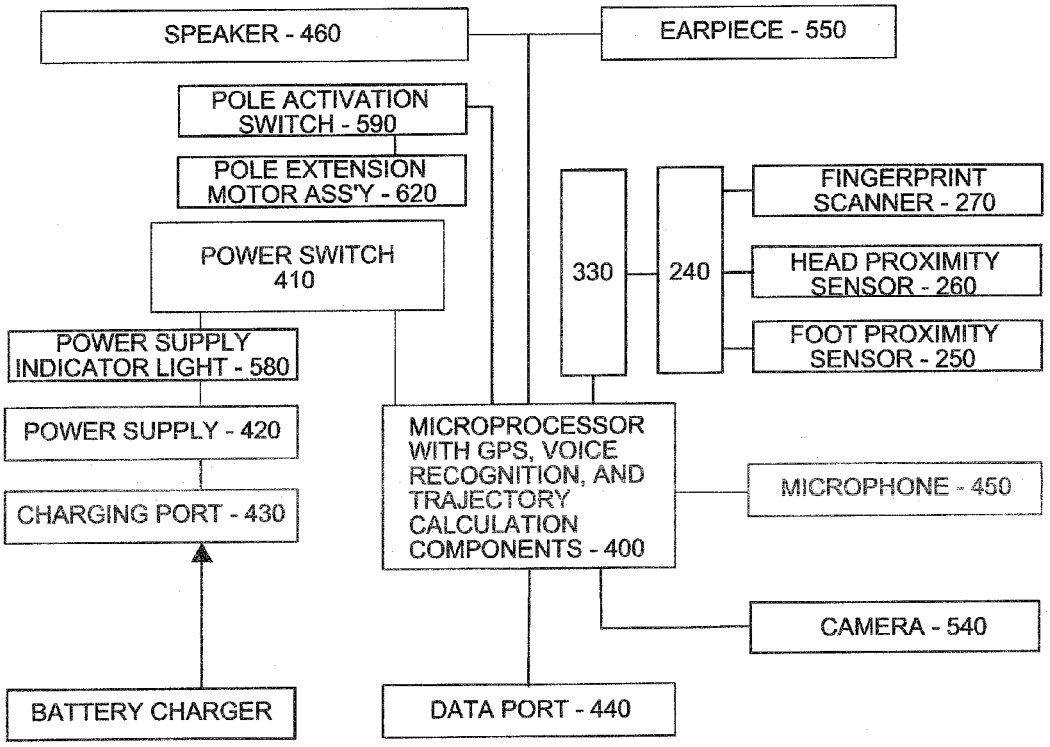
FIG. 4 is a schematic view of the present invention.
Figure 5:
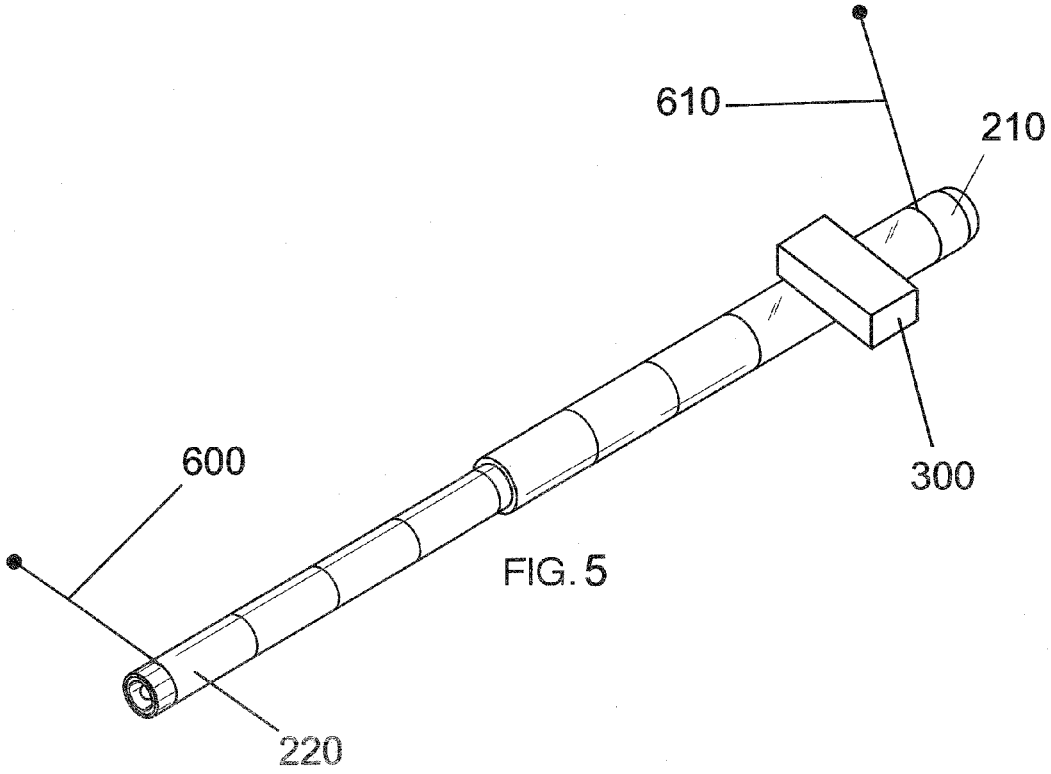
FIG. 5 is a perspective view of an alternate embodiment of the present invention.
Figure 6:
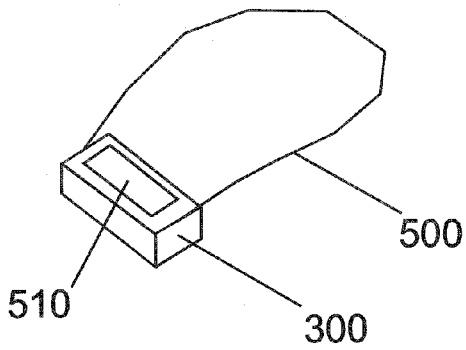
FIG. 6 is a perspective view of an alternate embodiment of the data processing module of the present invention.

Referring now to FIG. 1-6, the present invention features a mobility system (100) for the visually impaired having a removable data processing module (300) attached to a collapsible pole (200). In some embodiments, the system (100) comprises a generally elongated collapsible pole (200) having a pole first end (210), a pole second end (220), a module mount first interface (230), and a module mount power and data first interface (240) located on the pole (200).

In some embodiments, the collapsible pole (200) can be fixed in a first elongated position. In some embodiments, the collapsible pole (200) can be collapsed into a second collapsed position. In some embodiments, the collapsible pole (200) comprises a head proximity sensor (260) located on the collapsible pole (200) close to the pole first end (210) and a foot proximity sensor (250) located on the collapsible pole (200) close to the pole second end (220). In some embodiments, the collapsible pole (200) further comprises a fingerprint scanner (270) located on the collapsible pole (200) close to the pole first end (210).

In some embodiments, the system (100) comprises a data processing module (300) comprising a module housing (310) having a module mount second interface (320) for attaching to the module mount first interface (230) and a module mount power and data second interface (330) for operatively connecting with the module mount power and data first interface (240). In some embodiments, the module mount second interface (320) attaches to the module mount first interface (230) using a mated snap system. In some embodiments, the module mount second interface (320) attaches to the module mount first interface (230) using a mated lever system. In some embodiments, the module mount power and data second interface (330) connects with the module mount power and data first interface (240) using a mated plug connection.

In some embodiments, the data processing module (300) further comprises a microprocessor (400), a power switch (410), a power supply (420), a charging port (430), a data port (440), a microphone (450), and a speaker (460) located within the module housing (310). In some embodiments, the power switch (410) is operatively connected to the microprocessor (400). In some embodiments, the power switch (410) is located on the data processing module (300).

In some embodiments, the power supply (420) is operatively connected to the power switch (410). In some embodiments, the charging port (430) is operatively connected to the power supply (420). In some embodiments, the power supply (420) is a lithium battery. In some embodiments, the charging port (430) can be attached to a battery charger for charging the power supply (420).

In some embodiments, the data port (440) is operatively connected to the microprocessor (400). In some embodiments, the data port (440) can be used to transfer data to or from the microprocessor (400).

In some embodiments, the microphone (450) is operatively connected to the microprocessor (400). In some embodiments, the speaker (460) is operatively connected to the microprocessor (400). In some embodiments, the microprocessor (400) comprises an internal voice recognition component. In some embodiments, a voice input signal received using the microphone (450) can be converted into an instruction signal for the microprocessor (400).

In some embodiments, the microprocessor (400) comprises an internal global positioning system component. In some embodiments, the global positioning system component can be activated by and receive instructions from the voice recognition component. In some embodiments, the global positioning component can provide location information and directions for the user using the speaker (460).

In some embodiments, the data processing module (300) can be attached to the collapsible pole (200) using the module mount first interface (230) and the module mount second interface (320). In some embodiments, the data processing module (300) can be carried by the user using a strap (500) or a clip (510). In some embodiments, the fingerprint scanner, the foot proximity sensor (250), and the head proximity sensor (260) are operatively connected to the data processing module (300) using the module mount power and data first interface (240) and the module mount power and data second interface (330).

In some embodiments, the fingerprint scanner (270) is operatively connected to microprocessor (400). In some embodiments, the fingerprint scanner (270) can turn on or off the system (100) based on the fingerprint of the user. In some embodiments, the microprocessor (400) can activate an alarm using the speaker (460) upon detecting an unrecognized fingerprint of a second, unauthorized user.

In some embodiments, the foot proximity sensor (250) is operatively connected to the microprocessor (400). In some embodiments, the foot proximity sensor (250) located close to the pole second end (220) can detect an obstacle at or near ground level. In some embodiments, the microprocessor (400) can activate the alarm using the speaker (460) upon detecting an obstacle in the path of the user.

In some embodiments, the head proximity sensor (260) is operatively connected to the microprocessor (400). In some embodiments, the head proximity sensor (260) located close to the pole first end (210) can detect an obstacle at or near head level. In some embodiments, the microprocessor (400) can activate the alarm using the speaker (460) upon detecting an obstacle in the path of the user.

In some embodiments, the foot proximity sensor (250) comprises sonar technology. In some embodiments, the head proximity sensor (260) comprises sonar technology. In some embodiments, the foot proximity sensor (250) comprises laser technology. In some embodiments, the head proximity sensor (260) comprises laser technology.

In some embodiments, the system (100) comprises a reflective component (530) located on each section of the collapsible pole (200). In some embodiments, the reflective component (530) increases visibility of the user to others upon the presence of a light source. In some embodiments, the reflective component (530) is resistant to scratching, scraping or peeling.

In some embodiments, the system (100) comprises a camera (540) operatively connected to the microprocessor (400). In some embodiments, the fingerprint scanner (270) can turn on or off the camera (540) upon detecting an unrecognized fingerprint of a second, unauthorized user.

In some embodiments, the system (100) comprises a reflective component (530) located on each section of the collapsible pole (200). In some embodiments, the reflective component (530) increases visibility of the user to others upon the presence of a light source. In some embodiments, the reflective component (530) is resistant to scratching, scraping or peeling. In some embodiments, the system (100) comprises a camera (540) operatively connected to the microprocessor (400). In some embodiments, the fingerprint scanner (270) can turn on or off the camera (540) upon detecting an unrecognized fingerprint of a second, unauthorized user. In some embodiments, the reflective component (530) is positioned to direct an image to the camera (540).

In some embodiments, the reflective component (530) resembles a bicycle reflector. In some embodiments, the reflective component (530) resembles a mirror.

In some embodiments, the system (100) comprises an earpiece (550) having a speaker (460) operatively connected to the microprocessor (400). In some embodiments, the earpiece (550), when not in use is located in a pole first end (210). In some embodiments, the earpiece (550) comprises radio technology (Bluetooth®) for transmitting a signal to the microprocessor (400). In some embodiments, the earpiece (550) is rechargeable. In some embodiments, the earpiece (550) is wired directly to the microprocessor (400).

In some embodiments, the system (100) comprises an ergonomically comfortable handgrip (560). In some embodiments, the handgrip (560) changes the angle of gripping for the user to a more ergonomically correct position. For example, an angle of gripping between 0 and 90 degrees with respect to the pole (200).

In some embodiments, the system (100) comprises a wrist strap (570). In some embodiments, the wrist strap (570) is located on the pole first end (210).

In some embodiments, a trajectory calculation component is located in the microprocessor (400). In some embodiments, a trajectory of the user is determined using the ground proximity sensor, the handle proximity sensor, the microprocessor (400) and the global positioning system component. In some embodiments, the user can receive audio feedback using the speaker (460) to assist in determining and adjusting his trajectory. This will aid the user in walking straight, for example, like walking in a crosswalk.

In some embodiments, the system (100) comprises a power supply indicator light (580).

In some embodiments, the collapsible pole (200) is telescopically collapsible. In some embodiments, the collapsible pole (200) is foldably collapsible.

In some embodiments, the collapsible pole (200) is electronically activated into a position by a collapsible pole activation switch (590) operatively connected to a pole extension motor assembly (610). In some embodiments, the collapsible pole activation switch (590) is operatively connected to the power supply (420). In some embodiments, the collapsible pole (200) can be fixed in a first elongated position using the collapsible pole activation switch (590). In some embodiments, the collapsible pole (200) can be collapsed into a second collapsed position using the collapsible pole activation switch (590). In some embodiments, the pole extension motor assembly comprises a motor and gears to elongate or collapse the collapsible pole (200).

In some embodiments, the microprocessor (400) can be programmed to greet the user using the speaker (460) upon activation of the system (100) using the fingerprint scanner (270). In some embodiments, the greeting can be varied based on the time or the day.

In some embodiments, a mobility system (100) for the visually impaired has a removable data processing module (300) attached to a collapsible pole (200). In some embodiments, the system (100) comprises a generally elongated collapsible pole (200) having a pole first end (210), a pole second end (220), a module mount first interface (230), and a module mount power and data first interface (240) located on it. In some embodiments, the collapsible pole (200) can be fixed in a first elongated position. In some embodiments, the collapsible pole (200) can be collapsed into a second collapsed position.

In some embodiments, the collapsible pole (200) further comprises a generally linear elongated head proximity wand (610) pivotally located on the collapsible pole (200) close to the pole first end (210) and a generally linear elongated foot proximity wand (600) pivotally located on the collapsible pole (200) close to the pole second end (220). In some embodiments, the foot proximity wand (600) extends out and away from the collapsible pole (200) in an anterior, or forward direction with respect to the user. In some embodiments, the head proximity wand (610) extends out and away from the collapsible pole (200) in an anterior direction, or forward direction with respect to the user.

In some embodiments, the foot proximity wand (600) is between 1 and 12 inches. In some embodiments, the foot proximity wand (600) is between 12 and 24 inches. In some embodiments, the foot proximity wand (600) is between 24 and 36 inches. In some embodiments, the foot proximity wand (600) is between 36 and 48 inches. In some embodiments, the foot proximity wand (600) comprises a general shape of an arc. In some embodiments, the foot proximity wand is swivelably attached to the pole second end (220). In some embodiments, the foot proximity wand (600) can be made to alternatively swivel on either side of the collapsible pole (200) by the user to detect obstacles. In some embodiments, the foot proximity wand (600) can automatically alternatively swivel on either side of the collapsible pole (200) to detect obstacles in a similar manner as a metronome, for example, it can be electrically powered or spring powered.

In some embodiments, the head proximity wand (610) is between 1 and 12 inches. In some embodiments, the head proximity wand (610) is between 12 and 24 inches. In some embodiments, the head proximity wand (610) is between 24 and 36 inches. In some embodiments, the head proximity wand (610) is between 36 and 48 inches. In some embodiments, the head proximity wand (610) comprises a general shape of an arc. In some embodiments, the head proximity wand (610) is swivelably attached to the pole first end (210). In some embodiments, the head proximity wand (610) can be made to alternatively swivel on either side of the collapsible pole (200) by the user to detect obstacles. In some embodiments, the head proximity wand (610) can automatically alternatively swivel on either side of the collapsible pole (200) to detect obstacles in a similar manner as a metronome, for example, it can be electrically powered or spring powered.

In some embodiments, the collapsible pole (200) further comprises a fingerprint scanner (270) located on the collapsible pole (200) close to the pole first end (210).

In some embodiments, the system (100) comprises a data processing module (300) comprising a module housing (310) having a module mount second interface (320) for attaching to the module mount first interface (230) and a module mount power and data second interface (330) for operatively connecting with the module mount power and data first interface (240). In some embodiments, the data processing module (300) further comprises a microprocessor (400), a power switch (410), a power supply (420), a charging port (430), a data port (440), a microphone (450), and a speaker (460) located within the module housing (310).

In some embodiments, the power switch (410) is operatively connected to the microprocessor (400). In some embodiments, the power supply (420) is operatively connected to the power switch (410). In some embodiments, the charging port (430) is operatively connected to the power supply (420). In some embodiments, the data port (440) is operatively connected to the microprocessor (400). In some embodiments, the microphone (450) is operatively connected to the microprocessor (400). In some embodiments, the speaker (460) is operatively connected to the microprocessor (400). In some embodiments, the charging port (430) can be attached to a battery charger for charging the power supply (420). In some embodiments, the data port (440) can be used to transfer data to or from the microprocessor (400).

In some embodiments, the microprocessor (400) comprises an internal voice recognition component. In some embodiments, a voice input signal received using the microphone (450) can be converted into an instruction signal for the microprocessor (400).

In some embodiments, the microprocessor (400) comprises an internal global positioning system component. In some embodiments, the global positioning system component can be activated by and receive instructions from the voice recognition component. In some embodiments, the global positioning component can provide location information and directions for the user using the speaker (460).

In some embodiments, the data processing module (300) can be attached to the collapsible pole (200) using the module mount first interface (230) and the module mount second interface (320). In some embodiments, the data processing module (300) can be carried by the user using a strap (500) or a clip (510). In some embodiments, the fingerprint scanner is operatively connected to the data processing module (300) using the module mount power and data first interface (240) and the module mount power and data second interface (330).

In some embodiments, the fingerprint scanner (270) is operatively connected to microprocessor (400). In some embodiments, the fingerprint scanner (270) can turn on or off the system (100) based on the fingerprint of the user. In some embodiments, the microprocessor (400) can activate an alarm using the speaker (460) upon detecting an unrecognized fingerprint of a second, unauthorized user.

In some embodiments, the foot proximity wand (600) can detect an obstacle at or near ground level using physical contact as the user utilizes the system (100). In some embodiments, the head proximity wand (610) can detect an obstacle at or near head level using physical contact as the user utilizes the system (100).

As used herein, the term "about" refers to plus or minus 10% of the referenced number. For example, an embodiment wherein the housing is about 10 inches in length includes a housing that is between 9 and 11 inches in length.

The disclosures of the following U.S. Patents are incorporated in their entirety by reference herein: U.S. Pat. No. 7,317,927; U.S. Pat. No. 7,267,821; U.S. Pat. No. 6,774,795; U.S. Pat. No. 6,470,264, U.S. Pat. No. 6,356,210; U.S. Pat. No. 6,272,562; U.S. Pat. No. 5,807,111; U.S. Pat. Pub. No. 2008/0251110; U.S. Pat. Pub. No. 2006/0028544.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A mobility system (100) for the visually impaired having a removable data processing module (300) attached to a collapsible pole (200), wherein said system (100) comprises:

(a) a generally elongated collapsible pole (200) having a pole first end (210), a pole second end (220), a module mount first interface (230), and a module mount power and data first interface (240) disposed thereon, wherein the collapsible pole (200) can be fixed in a first elongated position, wherein the collapsible pole (200) can be collapsed into a second collapsed position, wherein the collapsible pole (200) further comprises a head proximity sensor (260) disposed on the collapsible pole (200) proximal to the pole first end (210) and a foot proximity sensor (250) disposed on the collapsible pole (200) proximal to the pole second end (220), wherein the collapsible pole (200) further comprises a fingerprint scanner (270) disposed on the collapsible pole (200) proximal to the pole first end (210); and (b) a data processing module (300) comprising a module housing (310) having a module mount second interface (320) for attaching to the module mount first interface (230) and a module mount power and data second interface (330) for operatively connecting with the module mount power and data first interface (240), wherein the data processing module (300) further comprises a microprocessor (400), a power switch (410), a power supply (420), a charging port (430), a data port (440), a microphone (450), and a speaker (460) disposed within the module housing (310), wherein the power switch (410) is operatively connected to the microprocessor (400), wherein the power supply (420) is operatively connected to the power switch (410), wherein the charging port (430) is operatively connected to the power supply (420), wherein the data port (440) is operatively connected to the microprocessor (400), wherein the microphone (450) is operatively connected to the microprocessor (400), wherein the speaker (460) is operatively connected to the microprocessor (400), wherein the charging port (430) can be attached to a battery charger for charging the power supply (420), wherein the data port (440) can be used to transfer data to or from the microprocessor (400), wherein the microprocessor (400) comprises an internal voice recognition component, wherein a voice input signal received using the microphone (450) can be converted into an instruction signal for the microprocessor (400), wherein the microprocessor (400) comprises an internal global positioning system component, wherein the global positioning system component can be activated by and receive instructions from the voice recognition component, wherein the global positioning component can provide location information and directions for the user using the speaker (460), wherein the data processing module (300) can be attached to the collapsible pole (200) using the module mount first interface (230) and the module mount second interface (320), wherein the data processing module (300) can be carried by the user using a strap (500) or a clip (510), wherein the fingerprint scanner, the foot proximity sensor (250), and the head proximity sensor (260) are operatively connected to the data processing module (300) using the module mount power and data first interface (240) and the module mount power and data second interface (330), wherein the fingerprint scanner (270) is operatively connected to microprocessor (400), wherein the fingerprint scanner (270) can turn on or off the system (100) based on the fingerprint of the user, wherein the microprocessor (400) can activate an alarm using the speaker (460) upon detecting an unrecognized fingerprint of a second, unauthorized user, wherein the foot proximity sensor (250) is operatively connected to the microprocessor (400), wherein the foot proximity sensor (250) disposed proximal to the pole second end (220) can detect an obstacle at or near ground level, wherein the microprocessor (400) can activate the alarm using the speaker (460) upon detecting an obstacle in the path of the user, wherein the head proximity sensor (260) is operatively connected to the microprocessor (400), wherein the head proximity sensor (260) disposed proximal to the pole first end (210) can detect an obstacle at or near head level, wherein the microprocessor (400) can activate the alarm via the speaker (460) upon detecting an obstacle in the path of the user.

2. The system (100) of claim 1, wherein the foot proximity sensor (250) comprises sonar technology.

3. The system (100) of claim 1, wherein the head proximity sensor (260) comprises sonar technology.

4. The system (100) of claim 1, wherein the foot proximity sensor (250) comprises laser technology.

5. The system (100) of claim 1, wherein the head proximity sensor (260) comprises laser technology.

6. The system (100) of claim 1, wherein the system (100) comprises a reflective component (530) disposed on each section of the collapsible pole (200), wherein the reflective component (530) increases visibility of the user to others upon the presence of a light source, wherein the reflective component (530) is resistant to scratching, scraping or peeling.

7. The system (100) of claim 1, wherein the system (100) comprises a camera (540) operatively connected to the microprocessor (400), wherein the fingerprint scanner (270) can turn on or off the camera (540) upon detecting an unrecognized fingerprint of a second, unauthorized user.

8. The system (100) of claim 1, wherein the system (100) comprises a reflective component (530) disposed on each section of the collapsible pole (200), wherein the reflective component (530) increases visibility of the user to others upon the presence of a light source, wherein the reflective component (530) is resistant to scratching, scraping or peeling, wherein the system (100) comprises a camera (540) operatively connected to the microprocessor (400), wherein the fingerprint scanner (270) can turn on or off the camera (540) upon detecting an unrecognized fingerprint of a second, unauthorized user, wherein the reflective component (530) is positioned to direct an image to the camera (540).

9. The system (100) of claim 1, wherein the system (100) comprises an earpiece (550) having a speaker (460) operatively connected to the microprocessor (400), wherein the earpiece (550), when not in use is disposed in a pole first end (210).

10. The system (100) of claim 1, wherein the earpiece (550) comprises radio technology (Bluetooth®) for transmitting a signal to the microprocessor (400).

11. The system (100) of claim 1, wherein the system (100) comprises an ergonomically comfortable handgrip (560).

12. The system (100) of claim 1, wherein the system (100) comprises a wrist strap (570).

13. The system (100) of claim 1, wherein a trajectory calculation component is disposed in the microprocessor (400), wherein the trajectory of the user is determined via the ground proximity sensor, the handle proximity sensor, the microprocessor (400) and the global positioning system component, wherein the user can receive audio feedback via the speaker (460) to assist in determining and adjusting his trajectory.

14. The system (100) of claim 1, wherein the system (100) comprises a power supply indicator light (580).

15. The system (100) of claim 1, wherein the collapsible pole (200) is telescopically collapsible.

16. The system (100) of claim 15, wherein the collapsible pole (200) is electronically activated by a collapsible pole activation switch (590) via the pole extension motor assembly (620), wherein the collapsible pole activation switch (590) is operatively connected to the power supply (420), wherein the collapsible pole (200) can be fixed in a first elongated position, wherein the collapsible pole (200) can be collapsed into a second collapsed position via the collapsible pole activation switch (590).

17. The system (100) of claim 1, wherein the microprocessor (400) can be programmed to greet the user via the speaker (460) upon activation of the system (100) via the fingerprint scanner (270), wherein the greeting can be varied based on the time or the day.

18. A mobility system (100) for the visually impaired having a removable data processing module (300) attached to a collapsible pole (200), wherein said system (100) comprises:

(a) a generally elongated collapsible pole (200) having a pole first end (210), a pole second end (220), a module mount first interface (230), and a module mount power and data first interface (240) disposed thereon, wherein the collapsible pole (200) can be fixed in a first elongated position, wherein the collapsible pole (200) can be collapsed into a second collapsed position, wherein the collapsible pole (200) further comprises a generally linear elongated head proximity wand (610) pivotally disposed on the collapsible pole (200) proximal to the pole first end (210) and a generally linear elongated foot proximity wand (610) pivotally disposed on the collapsible pole (200) proximal to the pole second end (220), wherein the foot proximity wand (600) extends out and away from the collapsible pole (200) in an anterior, or forward direction with respect to the user, wherein the head proximity wand (610) extends out and away from the collapsible pole (200) in an anterior direction, or forward direction with respect to the user, wherein the collapsible pole (200) further comprises a fingerprint scanner (270) disposed on the collapsible pole (200) proximal to the pole first end (210); and (b) a data processing module (300) comprising a module housing (310) having a module mount second interface (320) for attaching to the module mount first interface (230) and a module mount power and data second interface (330) for operatively connecting with the module mount power and data first interface (240), wherein the data processing module (300) further comprises a microprocessor (400), a power switch (410), a power supply (420), a charging port (430), a data port (440), a microphone (450), and a speaker (460) disposed within the module housing (310), wherein the power switch (410) is operatively connected to the microprocessor (400), wherein the power supply (420) is operatively connected to the power switch (410), wherein the charging port (430) is operatively connected to the power supply (420), wherein the data port (440) is operatively connected to the microprocessor (400), wherein the microphone (450) is operatively connected to the microprocessor (400), wherein the speaker (460) is operatively connected to the microprocessor (400), wherein the charging port (430) can be attached to a battery charger for charging the power supply (420), wherein the data port (440) can be used to transfer data to or from the microprocessor (400), wherein the microprocessor (400) comprises an internal voice recognition component, wherein a voice input signal received via the microphone (450) can be converted into an instruction signal for the microprocessor (400), wherein the microprocessor (400) comprises an internal global positioning system component, wherein the global positioning system component can be activated by and receive instructions from the voice recognition component, wherein the global positioning component can provide location information and directions for the user via the speaker (460), wherein the data processing module (300) can be attached to the collapsible pole (200) via the module mount first interface (230) and the module mount second interface (320), wherein the data processing module (300) can be carried by the user via a strap (500) or a clip (510), wherein the fingerprint scanner is operatively connected to the data processing module (300) via the module mount power and data first interface (240) and the module mount power and data second interface (330), wherein the fingerprint scanner (270) is operatively connected to microprocessor (400), wherein the fingerprint scanner (270) can turn on or off the system (100) based on the fingerprint of the user, wherein the microprocessor (400) can activate an alarm via the speaker (460) upon detecting an unrecognized fingerprint of a second, unauthorized user, wherein the foot proximity wand (600) can detect an obstacle at or near ground level via physical contact as the user utilizes the system (100), wherein the head proximity wand (610) can detect an obstacle at or near head level via physical contact as the user utilizes the system (100).

* * * * *